United States Patent [19]

Papay

[11] 4,158,633

[45] Jun. 19, 1979

[54] LUBRICATING OIL

[75] Inventor: Andrew G. Papay, Manchester, Mo.

[73] Assignee: Edwin Cooper, Inc., St. Louis, Mo.

[21] Appl. No.: 891,591

[22] Filed: Mar. 30, 1978

[51] Int. Cl.[2] ..... C10M 1/48; C10M 3/42; C10M 5/24; C10M 7/46

[52] U.S. Cl. ..... 252/32.7 E; 252/33; 252/33.4; 252/49.8

[58] Field of Search ..... 252/32.7 E, 49.8, 33, 252/33.4

[56] References Cited

U.S. PATENT DOCUMENTS

| | | | |
|---|---|---|---|
| 2,174,019 | 9/1939 | Sullivan | 252/49.8 |
| 2,274,291 | 2/1942 | Clayton et al. | 252/49.8 |
| 2,397,422 | 3/1946 | Kosolapoff | 260/961 |
| 2,436,141 | 2/1948 | Goebel | 260/961 |
| 3,172,892 | 3/1965 | Le Suer et al. | 252/51.5 A |
| 3,219,666 | 11/1965 | Norman et al. | 252/51.5 A |

FOREIGN PATENT DOCUMENTS

| | | | |
|---|---|---|---|
| 1247541 | 9/1971 | United Kingdom | 252/49.8 |

*Primary Examiner*—Delbert E. Gantz
*Assistant Examiner*—Irving Vaughn
*Attorney, Agent, or Firm*—Donald L. Johnson; Robert A. Linn; Joseph D. Odenweller

[57] ABSTRACT

Engine crankcase lubricating oil containing a dihydrocarbyl hydrocarbylphosphonate (e.g. dimethyl octadecylphosphonate) exhibits reduced friction which results in an increase in gasoline mileage thus conserving energy.

9 Claims, No Drawings

LUBRICATING OIL

BACKGROUND OF THE INVENTION

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

SUMMARY OF THE INVENTION

According to the present invention a lubricating oil containing a phosphonate additive is supplied for use in the crankcase of internal combustion engines. This new oil exhibits reduced friction and gives better fuel economy compared to the same fuel without the additive. The additive is a dihydrocarbyl hydrocarbylphosphonate.

Phosphonate additives have been used in lubricating oil compositions in the past. For example, British Pat. No. 1,247,541 discloses phosphonates in gear oil and automatic transmission fluids. Other references relating to their use are U.S. Pat. No. 2,174,019; U.S. Pat. No. 2,274,291; U.S. Pat. No. 2,397,422 and U.S. Pat. No. 2,436,141.

DESCRIPTION OF THE PREFERRED EMBODIMENTS

A preferred embodiment of the invention is an internal combustion engine crankcase lubricating oil composition having a lubricating viscosity up to SAE 40, said composition comprisig a major amount of a lubricating oil and a minor friction-reducing amount of a phosphonate having the formula

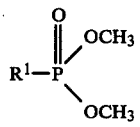

wherein $R^1$ is an alkyl or alkenyl group containing about 12–30 carbon atoms.

Examples of these phosphonates are dimethyl triacontylphosphonate, dimethyl triacontenylphosphonate, dimethyl eicosylphosphonate, dimethyl hexadecylphosphonate, dimethyl hexadecenylphosphonate, dimethyl tetracontenylphosphonate, dimethyl hexacontylphosphonate, dimethyl dodecylphosphonate, dimethyl dodecenylphosphonate and the like.

In a more preferred embodiment $R^1$ is an alkyl or alkenyl group containing about 16–20 carbon atoms. Examples of these more preferred phosphonates are dimethyl hexadecylphosphonate, dimethyl hexadecenylphosphonate, dimethyl octadecylphosphonate, dimethyl octadecenylphosphonate, dimethyl eicosylphosphonate and the like.

The most preferred additive is dimethyl octadecylphosphonate.

The phosphonates are added to the lubricating oil in an amount which reduces the friction of the engine operating with the oil in the crankcase. A useful concentration is about 0.05–3 wt %. A more preferred range is about 0.3–1.5 wt %.

From the above it can be seen that the present invention provides an improved crankcase lubricating oil. Accordingly, an embodiment of the invention is an improved motor oil composition formulated for use as a crankcase lubricant in an internal combustion engine wherein the improvement comprises including in the crankcase oil an amount sufficient to reduce fuel consumption of the engine of a dimethyl $C_{12-30}$ hydrocarbylphosphonate.

In a highly preferred embodiment such improved motor oil also contains an ashless dispersant, a zinc dialkyldithiophosphate and an alkaline earth metal salt of a petroleum sulfonic acid or an alkaryl sulfonic acid (e.g. alkylbenzene sulfonic acid).

The additives can be used in mineral oil or in synthetic oils of viscosity suitable for use in the crankcase of an internal combustion engine. Crankcase lubricating oils have a viscosity up to about 80 SUS at 210° F. According to the present invention dimethyl $C_{12-30}$ hydrocarbylphosphonates function to increase fuel economy when added to lubricating oil compositions formulated for use in the crankcase of internal combustion engines. Similar mileage benefits could be obtained in both spark ignited and diesel engines.

Crankcase lubricating oils of the present invention have a viscosity up to about SAE 40. Sometimes such motor oils are given a classification at both 0° and 210° F., such as SAE 10W 40 or SAE 5W 30.

Crankcase lubricants of the present invention can be further identified since they usually contain a zinc dihydrocarbyl dithiophospate in addition to the phosphonate additive. Likewise, these crankcase lubricants contain an alkaline earth metal sulfonate such as calcium petroleum sulfonate, calcium alkaryl sulfonate, magnesium petroleum sulfonate, magnesium alkaryl sulfonate, barium petroleum sulfonate, barium alkaryl sulfonate and the like.

Mineral oils include those of suitable viscosity refined from crude oil from all sources including Gulfcoast, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$ α-olefins such as α-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are diodecyladipate, trimethylol propane tripelargonate, pentaerylthritol tetracaproate, di(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 10–25 wt % hydrogenated α-decene trimer with 75–90 wt % 150 SUS (100° F.) mineral oil results in an excellent lubricant. Likewise, blends of about 10–25 wt % di(2-ethylhexyl-)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate in combination with the dihydrocarbyl hydrocarbyl phosphonate. When these additives are used in combination very significant increases in fuel economy have been achieved. Both zinc dialkyldithiophosphates and zinc dialkaryldithiophosphates as well as mixed alkyl-aryl dithiophosphates can be used. Examples of these are zinc dihydrocarbyldithiophosphate in which the hydrocarbyl groups are a mixture of isobutyl and isoamyl alkyl groups. Likewise, zinc dinonylphenyldithiophosphate can be used with good results. Good results are achieved using sufficient zinc dihydrocarbyldithiophosphate to provide about 0.01–0.5 wt % zinc. A preferred concentration supplies about 0.05–0.3 wt % zinc.

Another additive used in the oil compositions are the alkaline earth metal petroleum sulfonate or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 wt % alkaline earth metal and more preferably about 0.1–1.0 wt %.

Viscosity index improvers can be included such as the polyalkylmethacrylate type or the ethylene-propylene copolymer type. Likewise, styrene-diene VI improvers can be used. Alkaline earth metal salts of phosphosulfurized polyisobutylene are useful. Preferred crankcase oils also contain an ashless dispersant such as the polyolefin succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. No. 3,172,892 and U.S. Pat. No. 3,219,666 incorporated herein by reference.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,762,882; 3,736,357; 3,751,365; 3,756,953; 3,793,202; 3,798,165; 3,798,247; and 3,803,039.

The above dispersants can be reacted with boric acid to form boronated dispersants having improved corrosion properties.

Tests have been carried out which demonstrate the ability of the present oil composition to significantly improve fuel economy. Initially, friction tests were conducted. These tests were made using a bench apparatus in which a steel annulus and a steel plate were pressed against each other under 229 psi load. The steel annulus was rotated at 40 lineal ft/min and the torque required to start (static friction) and to maintain rotation (kinetic friction) was measured. The rubbing interface of the annulus and steel plate was lubricated with the test lubricating oil.

The base motor oil used in the test was formulated using neutral mineral oil. The base formulation included a commercial ashless dispersant (i.e. polyisobutylsuccinimide of polyethylene polyamine), a zinc dialkyldithiophosphate, an overbased calcium alkylbenzene sulfonate (300 base number), a phenolic antioxidant and a commercial polyacrylate VI improver. Both static and kinetic coefficient of friction were measured for the base oil and the base oil containing various concentrations of dimethyl octadecylphosphonate. The results are given in the following table:

TABLE A

| | Coefficient of friction | | Percent decrease in friction | |
|---|---|---|---|---|
| Conc (wt %) | static | kinetic | static | kinetic |
| 0 | .0620 | .0536 | — | — |
| 0.5 | .0539 | .0490 | 13.1 | 8.6 |
| 0.75 | .0521 | .0485 | 16.0 | 9.5 |
| 1.0 | .0501 | .0444 | 19.2 | 17.2 |
| 1.5 | .0478 | .0444 | 22.9 | 17.2 |

Similar, but slightly lower friction reductions were obtained using a different base oil which contained a different phenolic antioxidant.

Since it has been found that some additives which reduce friction in a bench test do not improve fuel economy in actual use, further tests were carried out in a 1977 U.S. production automobile having a V6 engine. The car was operated on a chassis dynamometer under controlled temperature and humidity conditions. Each test sequence consisted of four consecutive EPA city/-highway cycles plus a 50 mph steady state cycle. The first cycle started with a cold engine (32° F.). The subsequent three cycles started with the warmed-up engine. Gasoline consumption in mpg during the test was measured at frequent intervals by weight and also by volume.

The base oil used in the automobile test was the same base oil used in the bench test except it was pre-sheared by operating for the equivalent of 1,000 miles in a dynamometer engine to eliminate the effect of oil thinning during the actual test. Viscosity index improvers tend to shear during their initial use causing a decrease in the viscosity of the oil. Improved mileage due to such thinning can mask the effect of the test additive.

The mpg data obtained during each cycle of the test sequence was then analyzed by computer regression analysis to eliminate variances due to barometric change and inherent engine trend during the test. This gave the true mpg at the 95–99% confidence level. The test sequence was conducted using the base oil and again using the same base oil plus 1 wt % of dimethyl octadecylphosphonate. The results are reported in the following table in terms of % improvement over base line.

TABLE B

| Test Cycle | Improvement in mpg |
|---|---|
| Cold start transient[1] | 3.4% |
| Cold start city cycle | 2.8% |
| Hot start city cycle | 2.0% |
| Hot start highway cycle | 1.1% |

TABLE B-continued

| Test Cycle | Improvement in mpg |
|---|---|
| 50 mph steady | 1.3% |

[1]measured during first 3.6 miles of the 11.1 mile city cycle.

As further evidence of the beneficial effect of the additive, the temperature of the oil in the engine crankcase was measured during the warmed-up portion of the city and highway cycles. The oil containing dimethyl octadecylphosphonate ran cooler than the base oil during both cycles. The following table shows the °F. reduction in crankcase oil temperature of the phosphonate additive oil compared to the base oil.

TABLE C

| Test cycle | Reduction in Temp. |
|---|---|
| Warmed-up city | 11° F. |
| Warmed-up highway | 8° F. |

The decrease in oil temperature indicated a reduction in heat-producing friction waste.

I claim:

1. In a motor oil composition formulated for use as a crankcase lubricant for internal combustion engines, said formulated oil containing an ashless dispersant and an oil soluble alkaline earth metal salt of a petroleum sulfonic acid or an alkaryl sulfonic acid, the improvement comprising including an amount sufficient to reduce fuel consumption of said engine of a dimethyl $C_{12-30}$-alkyl phosphonate said improvement functioning to reduce fuel consumption of an internal combustion engine when said motor oil composition is used as the crankcase lubricating oil in said engine.

2. An improved motor oil composition of claim 1 wherein said phosphonate is dimethyl octadecylphosphonate.

3. An improved oil composition of claim 1 containing 0.01–0.5 wt % zinc as an oil soluble zinc dihydrocarbyldithiophosphate.

4. An improved oil composition 3 wherein said phosphonate is a dimethyl octadecylphosphonate.

5. An improved composition of claim 1 containing an oil soluble alkaline earth metal salt of a petroleum sulfonic acid or alkaryl sulfonic acid in an amount which provides about 0.05–1.0 wt % alkaline earth metal in said oil composition.

6. An improved oil composition of claim 5 wherein said phosphonate is dimethyl octadecylphosphonate.

7. An improved oil composition of claim 2 containing about 0.01–0.5 wt % zinc as an oil soluble zinc dialkyl dithiophoshate and about 0.05–1.5 wt % alkaline earth metal as an oil soluble alkaline earth metal petroleum sulfonate or alkaline earth metal alkaryl sulfonate.

8. A method of lowering the fuel consumption of an internal combustion engine, said method comprising adding a motor oil composition of claim 1 to the crankcase of said engine.

9. A method of claim 8 wherein said phosphonate is dimethyl octadecylphosphonate.

* * * * *